United States Patent [19]

O'Brien

[11] 4,310,039

[45] Jan. 12, 1982

[54] WOOD SPLITTER

[76] Inventor: John T. O'Brien, Rte. #1, Webster, Wis. 54893

[21] Appl. No.: 98,222

[22] Filed: Nov. 28, 1979

Related U.S. Application Data

[63] Continuation-in-part of Ser. No. 32,156, Apr. 23, 1979, abandoned.

[51] Int. Cl.[3] ..... B27L 7/00

[52] U.S. Cl. ..... 144/193 A

[58] Field of Search ..... 144/193 R, 193 A, 3 K, 144/194, 1 C; 105/393; 82/24, 32

[56] References Cited

U.S. PATENT DOCUMENTS

| | | | |
|---|---|---|---|
| 3,319,675 | 5/1967 | Bles, Sr. | 144/193 R |
| 3,988,814 | 11/1976 | Hoffman | 144/1 C |
| 4,141,396 | 2/1979 | McCallister | 144/194 X |
| 4,153,088 | 5/1979 | King et al. | 144/193 R X |
| 4,239,070 | 12/1980 | Burns | 144/193 A |

*Primary Examiner*—W. D. Bray

*Attorney, Agent, or Firm*—Merchant, Gould, Smith, Edell, Welter & Schmidt

[57] ABSTRACT

A hydraulic wood splitter including a trackway (57) (157) (225) and a carriage (60) (160) (230) movable therealong, the trackway including a main rail (26) (126) (201), a pair of guide rails (50, 51) (150, 151) (213, 220) parallel thereto and spaced therefrom, and a plurality of spaced splitter elements (80, 81) (180, 181) (210, 211, 212), and the carriage including a ram or rams (74) (124) (235, 236) located at all times between said splitter elements: the carriage is reversibly moved along the trackway by actuating means (34) **(134*a*, 134*b*) (240, 241) and may include a saddle (161) or a pair of saddles (61, 62) (231, 232)** mutually spaced in the direction of the trackway.

10 Claims, 12 Drawing Figures

WOOD SPLITTER

This is a continuation-in-part of my copending application filed Apr. 23, 1979, Ser. No. 32,156 and now abandoned.

BACKGROUND OF THE INVENTION

This invention relates to the field of machines for performing splitting operations, in connection with the preparation of fire wood and the like.

Traditionally, wood blocks are split lengthwise by the impact of heavy axes, if the wood splits readily, or by the use of wedges or splitting mauls driven into and through the wood by sledges. While picturesque, this is a very laborious and time consuming procedure, and with the advent of hydraulic power various splitters have been developed for hydraulic operation. Such machines are designed to cause relative motion linearly between a workpiece to be split and a splitter element, it being known to hold either stationary while the other is reciprocated.

Very great forces are required to split workpieces, particularly where the wood is very knotty or the grain is twisted. The end of the workpiece is seldom perpendicular to the grain, so that the force at the entering line of the splitter element usually has one or more components transverse to the relative motion. Such forces tend to distort the mechanism and to cause binding between relatively movable parts, increasing the load on the driving system and shortening the life of the machine. These disadvantages are increased when it is attempted to split in both directions of the machine line.

SUMMARY OF THE INVENTION

I have invented a structure in which movement of a workpiece is accomplished by a ram powered through a carriage movable along a trackway, the motion being guided by means engaging guide rails in the trackway to prevent appreciable components of carriage motion in any transverse direction. A first embodiment uses a single drive motor, and the carriage is elongated to give additional transverse control. A second embodiment of the invention uses a pair of drive motors, which inherently compensate for considerable transverse force between the workpiece and the driving mechanism, so that less length of carriage is needed for functional stability. A third embodiment of the invention is arranged to split a pair of workpieces for each stroke of the carriage in each direction.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described preferred embodiments of the invention.

DESCRIPTION OF THE PREFERRED EMBODIMENTS

Figures 1, 2, 3:
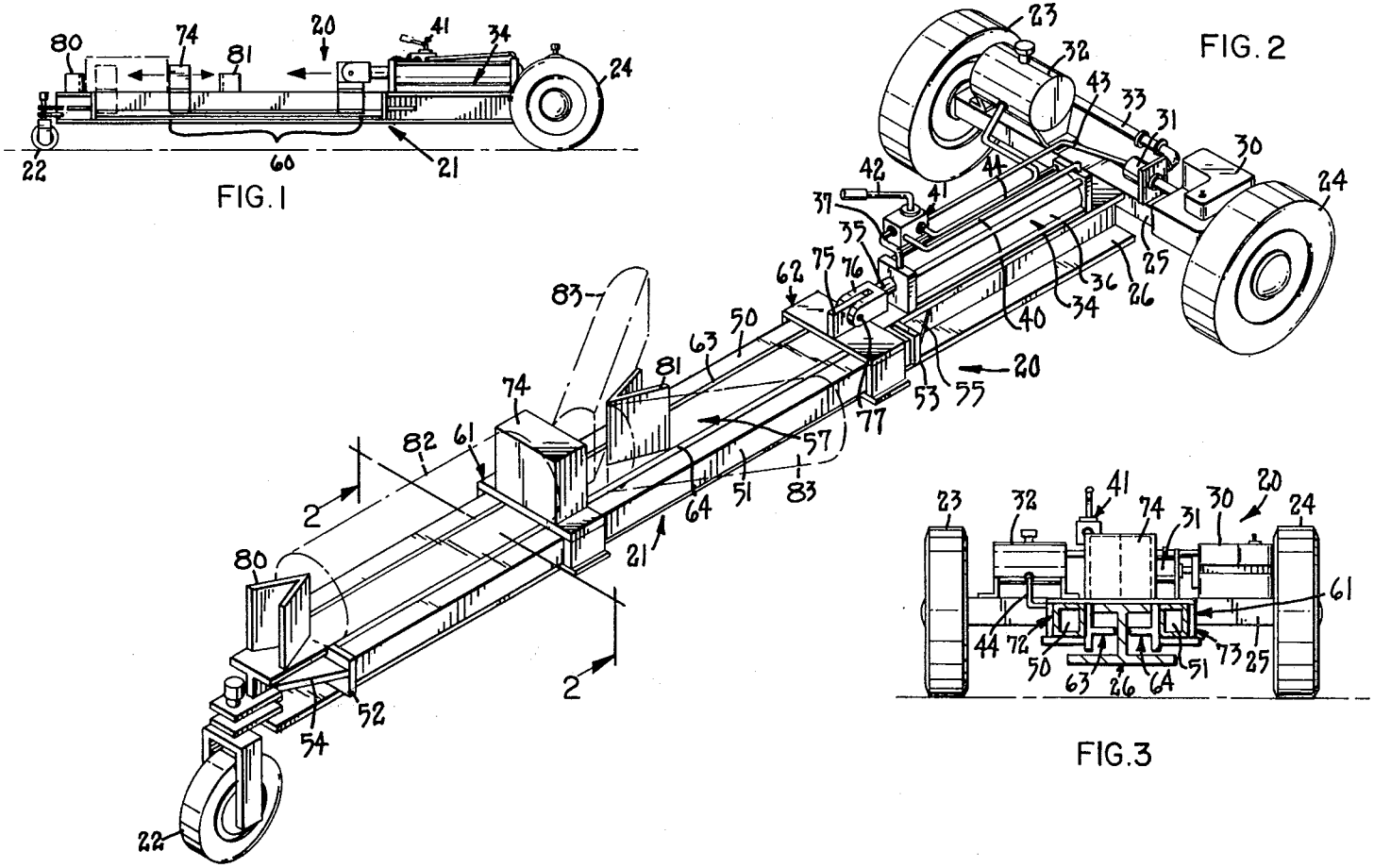
FIG. 1 is a side elevational view of a first embodiment of the invention.
FIG. 2 is a perspective view of this structure, to a larger scale.
FIG. 3 is a sectional view along the line 3—3 of FIG. 2.

Referring now to FIGS. 1–5 my splitter 20 is shown to comprise a frame 21 supported at one end by a caster wheel 22 and at the other end by wheels 23, 24 mounted on an axle 25 to which the main rail 26 of the frame is secured in any suitable fashion.

Mounted on axle 25 are an engine 30, a hydraulic pump 31 driven by engine 30, and a reservoir 32 for hydraulic fluid, connected to pump 31 by a conduit 33. A double action linear hydraulic motor 34 is carried on main rail 26, and includes an actuator 35 carrying a piston within a cylinder 36. Conduits 37 and 40 connect the ends of cylinder 35 with a two-way hydraulic valve 41 having an operating handle 42. Valve 41 is connected to pump 31 by a supply conduit 43, and to reservoir 33 by a return conduit 44.

Figure 4:
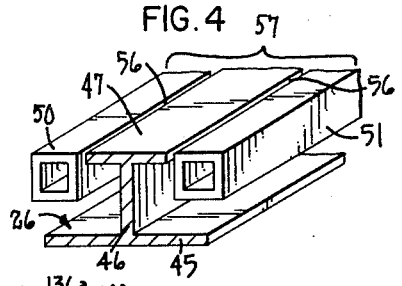
FIG. 4 is a detailed fragmentary sectional view to a larger scale of a trackway used in the structure of FIGS. 1–3.

Main rail 26 is conventionally of I-beam construction, as shown in FIG. 4, and comprises a lower flange 45 joined by a web 46 to an upper flange 47 which may be somewhat narrower than flange 45 if desired. A pair of guide rails 50 and 51 are secured to main rail 26 in spaced parallel relation. Thus, in FIG. 2 brackets 52 and 53, reinforced by braces 54 and 55, are secured to the ends of guide rail 51 and to web 46 and the undersurface of flange 47, leaving a space 56 between flange 47 and guide rail 51 for the entire length of the latter. Similar structure is provided for guide rail 50. Rails 26, 50 and 51 thus cooperate to comprise a trackway 57, the length of which is determined by the lengths of guide rails 50 and 51.

Figure 5:
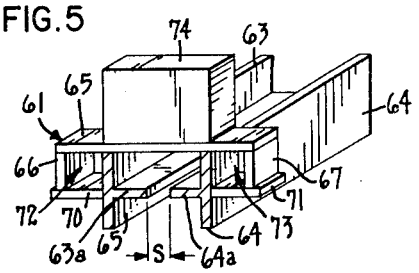
FIG. 5 is a detailed fragmentary sectional view to a larger scale of a carriage used in the structure of FIGS. 1–3.

A carriage 60 is arranged to slide longitudinally on and in trackway 57, and is shown to comprise a first saddle 61 and a second saddle 62 interconnected by longitudinal members 63 and 64 which are of T-configuration in section, and have portions **63*a* and 64*a* projecting toward one another to define a space "S" slightly greater than the thickness of web 46. As shown in FIG. 5, saddle 61 is connected to members 63 and 64 at first ends thereof, and consists of an upper plate 65, side plates 66 and 67 and bottom plates 70 and 71. These plates combine with members 63 and 64 to define sleeves 72 and 73 in which guide rails 50 and 51 make sliding fits. Saddle 62 at the other end of members 63 and 64** is similarly constructed.

A ram 74 is mounted on plate 65 of saddle 61. Saddle 62 carries a rib 75 to which actuator 35 is connected by a clevis 76 and pin 77. A pair of splitter elements are mounted on flange 47 in apposed, spaced relation: thus a wedge-shaped splitter element 80 is mounted near the end of rail 26 remote from hydraulic motor 53, and a second wedge-shaped splitter element 81 is mounted on rail 26 generally midway along its length. Ram 74 is between splitter elements 80 and 81 for all positions of actuator 35. In the condition of the equipment shown in FIG. 2, the space between ram 74 and splitter element 80 is slightly greater than the length of a workpiece to be split, and in the extended position of actuator 35 ram 74 is displaced from splitter element 81 by the same amount. The travel of carriage 60 is sufficient to accomplish splitting of a workpiece whether urged against element 80 or against element 81.

In FIG. 2 a workpiece to be split is suggested in broken lines at 82, and a second workpiece after splitting is similarly shown at 83.

Figure 6:
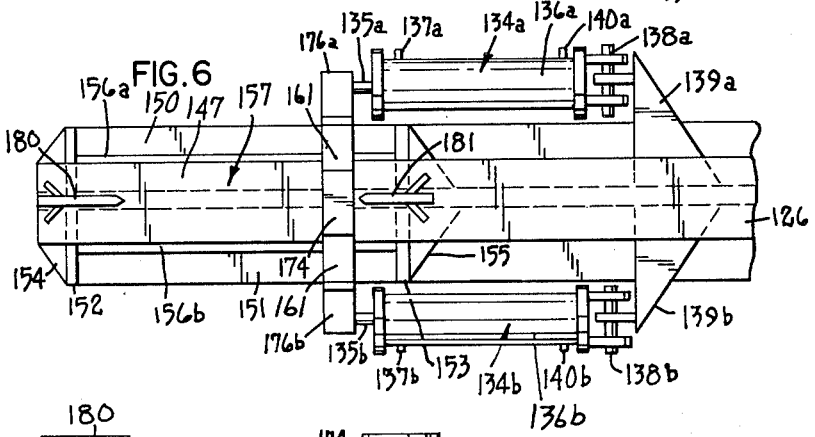
FIG. 6 is a plan view of a second embodiment of the invention.
Figure 7:
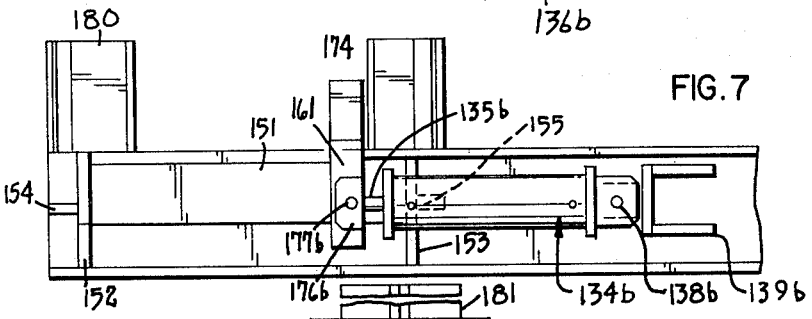
FIG. 7 is a side view of the structure of FIG. 6.
Figure 8:
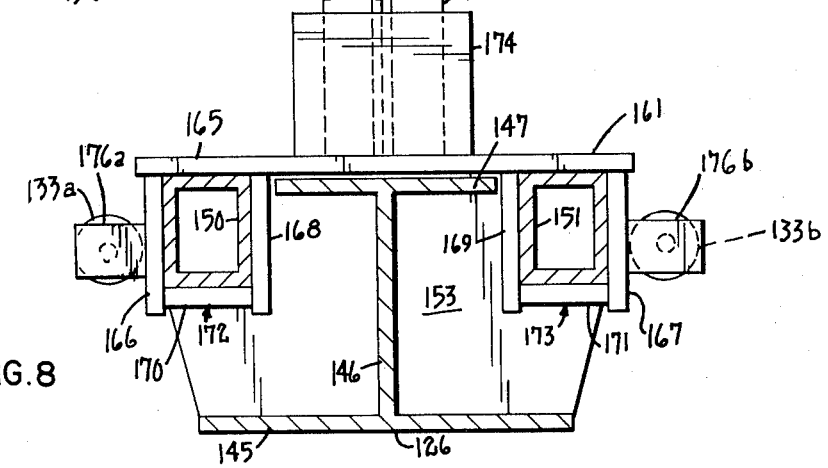
FIG. 8 is a sectional view to a larger scale along the line 8—8 of FIG. 6.

A second embodiment of the invention is shown in FIGS. 6–8 to comprise a main rail 126 having flanges 145 and 147 and a web 146, a first guide rail 151 secured thereto by brackets 152 and 153 with braces 154 and 155, and a second guide rail 150 similarly secured to rail 126 to complete a trackway 157. In this structure a pair of linear hydraulic motors **134*a* and 134*b* have cylinders 136*a* and 136*b*, pivotally connected by pins 138*a* and 138*b* to brackets 139*a* and 139*b* secured to rail 126, and actuators 135*a* and 135*b* connected by shackles 176*a* and 176*b*, pins such as 177*b* and brackets 178*a* and 178*b* to a carriage 160 comprising a single saddle 161 on which a ram 174 is mounted. Saddle 161 comprises a top plate 165, side plates 166 and 167, bottom plates 170 and 171, and inner plates 168 and 169, which cooperate to define sleeves 172 and 173 for guide rails 150 and 151, plate 169 passing through the space 156*b* between rail 151 and flange 147, and plate 168 similarly passing through the space 156*a* between rail 150 and flange 147**.

A pair of spaced apposed splitter elements 180 and 181 are mounted on rail 126, with ram 174 between them. The hydraulic system for this embodiment is the same as that previously described, except that the two cylinders are connected in parallel. Conduit 37 from valve 41 is to be connected to cylinder connections **137*a* and 137*b*, and conduit 40 from valve 41 is to be connected to cylinder connections 140*a* and 140*b***.

Another embodiment of the invention is shown in FIGS. 9–12 to comprise a main rail 201 supported on an axle 202 by a pair of wheels 203, 204. A caster wheel 205 is mounted at one end of rail 201 by a suitable bracket 206, and the other end of the rail is supported by an adjustable jack screw 207 in a bracket 208. A pair of inwardly directed splitting members 210 and 211 are secured to the top of rail 201 at its ends, and a double-faced splitting member 212 is secured to the top of rail 210 near its center.

A first guide rail 213 is mounted on one side of rail 201 near its top by brackets 214 and 215 and braces 216 and 217 near the ends of rail 201, from which guide rail 213 is spaced laterally, and a second guide rail 220 is similarly mounted on the opposite side of rail 201 near its top ends by brackets 221 and 222 and braces 223 and 224. Rails 201, 213 and 220 comprise a trackway 225.

A carriage 230 slides on the top of rail 201, and comprises a pair of saddles 231 and 232 interconnected by angle iron rails 233 and 234 passing under guide rails 213 and 220 and in the spaces between these guide rails and main rail 201. Saddle 231 is located between splitting members 210 and 212, and saddle 232 is between splitting elements 211 and 212. A pair of rams 235 and 236 project upwardly from saddles 231 and 232 respectively.

Carriage 230 is displaced along rail 201 by a pair of linear hydraulic motors 240 and 241 mounted on opposite sides of main rail 201. Motor 240 is shown to comprise a cylinder 242 having hydraulic connections 243 and 244 at its opposite ends, and an actuator 245 movable in cylinder 242. Cylinder 240 is pivotally supported at the end remote from actuator 245 by a pin 246 carried in a bracket 247 secured to the side of rail 201. Actuator 244 is pivotally connected by a clevis 250 and a pin 251 to a bracket 252 secured below saddle 231. Motor 241 is similarly constructed and mounted. The hydraulic connections 243 of cylinders 240 and 241 are connected together, by a conduit 253, which extends to a hydraulic control valve 254 which may be mounted on axle 202. Hydraulic connections 244 of cylinders 240 and 241 are connected together by a conduit 255 extending to valve 254. Pressure fluid is conveyed from a suitable source not shown to valve 254 by a conduit 256, and a conduit 257 discharges fluid to a suitable reservoir also not shown.

Operation

In use my splitter is transported to the site of a supply of workpieces, such as logs cut to fireplace lengths. Engine 30 is set in operation and hydraulic fluid under pressure is supplied to valve 41 through conduit 43. In FIG. 2, with valve 41 in the position shown, hydraulic pressure is supplied through conduit 37 to the left end of cylinder 36, and actuator 37 is withdrawn within cylinder 36, fluid being returned to reservoir 32 through conduit 40, valve 41, and conduit 44. Actuator 35 drives carriage 60 toward splitter element 81 to the end of its range.

A workpiece is now placed between splitter element 80 and ram 74, and handle 42 is turned to its second position, in which hydraulic fluid from conduit 43 is supplied by valve 41 through conduit 40 to the other end of cylinder 36. The actuator is moved to the left, fluid being returned through conduit 37, valve 41, and conduit 44 to reservoir 32. Actuator 35 drives carriage 60 away from splitter element 81 to the end of its range, ram 74 forcing the workpiece against element 80 with such force that the workpiece is split and falls from trackway 57.

The splitter is now in a condition where a second workpiece can be placed on trackway 57 between ram 74 and splitter element 81. Reversing valve 41 reverses the movement of ram 74, to force the workpiece against splitter element 81 with such power that the piece is split, and the machine has returned to the condition shown in FIG. 2.

It is evident that the length of carriage 60 between saddles 61 and 62, the fit of sleeves 72 and 73 against guide rails 50 and 51, the engagement of members 63 and 64 in spaces 56, and the engagement of portions **63*a* and 64*a* with web 46** all prevent operation of the splitter from being interfered with if a workpiece is not placed centrally on the trackway, or if the grain in the workpiece is such that the split does not occur centrally. The structure is rugged and can withstand the abuse to which such machines are subjected. Successful operation with a single hydraulic motor is achieved, without any binding or twisting in the mechanism, regardless of the load.

The operation of the structure shown in FIGS. 6–8 is quite the same. Because of the provision of two hydraulic motors, the need of considerable length in the ram carriage mechanism is decreased, and plates 168 and 169 no longer than the width of plate 165 are found adequate, even without the projections to engage web 146. The configuration of splitter elements 180 and 181 departs from the simple wedges used in the first embodiment, to give easier initial penetration of the workpiece with the same ultimate splitting efficiency. Saddle 161 is still closely stabilized in trackway 157, by sleeves 172 and 173 and by plates 168 and 169 in spaces 156*a* and 156*b*.

Figure 9:
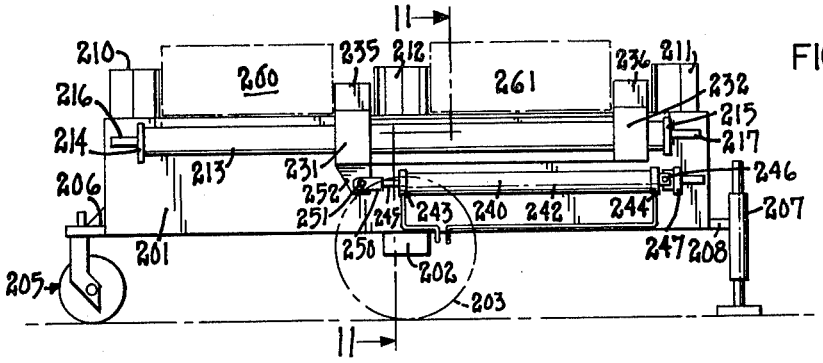
FIG. 9 is a view in side elevation of another embodiment of the invention.
Figure 10:
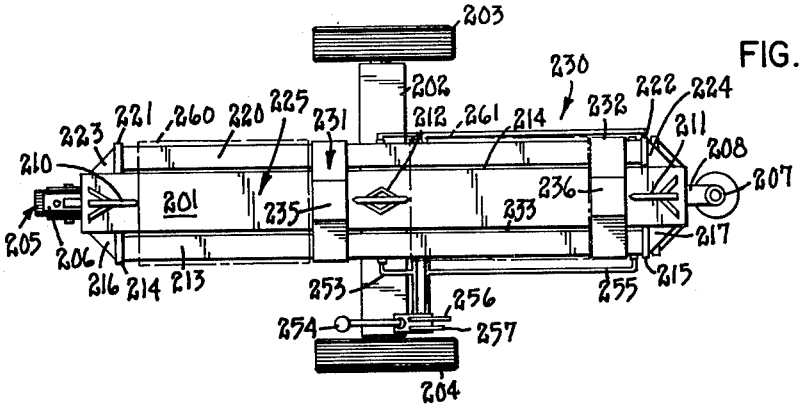
FIG. 10 is a plan view of a section of FIG. 9.
Figure 11:
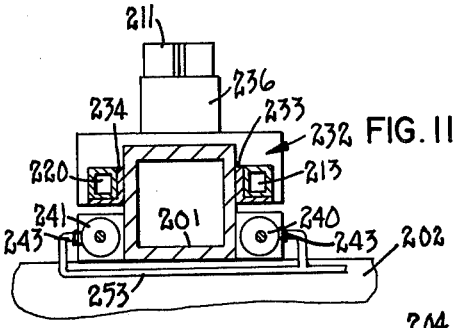
FIG. 11 is a sectional view taken along the line 11—11 of FIG. 9.
Figure 12:
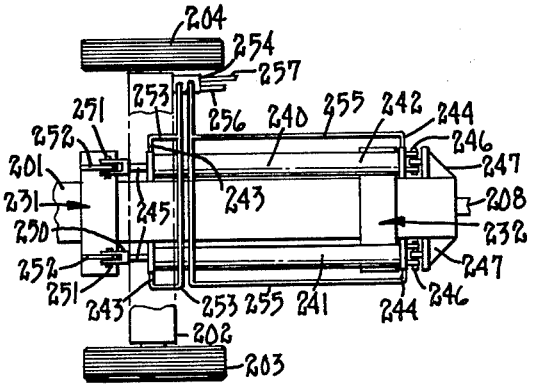
FIG. 12 is a bottom plan view of the structure of FIG. 9.

The operation of the structure shown in FIGS. 9–12 has the advantages of a double hydraulic motor arrangement, but by reason of the double saddles of carriage 230 a pair of workpieces can be split at each stroke of the carriage in each direction thereof, practically doubling the output of the machine. As shown in FIG. 9, a pair of workpieces 260 and 261 are positioned, the one between splitting element 210 and ram 235, and the other between splitting element 212 and ram 236. When valve 254 is actuated to supply pressure fluid to connections 244 and enable fluid to be discharged from connections 243, the motors drive their actuators and carriage 230 to the left as seen in FIGS. 9 and 10, causing workpieces 260 and 261 to be split at 210 and 212. The workpieces fall away, with saddles 231 and 232 near splitting elements 210 and 212 respectively. New workpieces are now inserted, one between ram 231 and splitting element 212 and the other between ram 232 and splitting element 211, valve 254 is operated to reverse the supply of hydraulic fluid, and carriage 230 is driven to the right, to split the workpieces at 212 and 211.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed:

1. In a wood splitter, in combination:

an elongated main rail;

a guide rail aligned with and spaced from said main rail to form therewith a longitudinal trackway;

means securing said guide rail at its ends to said main rail, to define the length of said trackway;

a carriage movable longitudinally along said trackway, including means engaging said guide rail;

power means for causing reversible movement of said carriage along said trackway;

apposed tapered splitter elements carried by said main rail in longitudinally aligned, mutually spaced relation; and a ram carried by said carriage for longitudinal movement between said splitter elements.

2. In a wood splitter, in combination:

an elongated main rail;

a pair of guide rails aligned with and spaced oppositely from said main rail, to form therewith a longitudinal trackway;

means securing said guide rails at their ends to said main rail to define the length of said trackway;

a carriage movable longitudinally along said trackway, including sleeves engaging said guide rails;

power means for causing reversible movement of said carriage along said trackway;

a pair of apposed tapered splitter elements carried by said main rail in longitudinally aligned, mutually spaced relation; and a ram carried by said carriage for longitudinal movement between said splitter elements.

3. A splitter according to claim 2 in which said carriage includes first and second saddles separated by a longitudinal distance less than said length of said trackway.

4. A splitter according to claim 2 in which said power means comprises a pair of linear motors acting longitudinally on said carriage at sites outward of said guide rails.

5. A splitter according to claim 3 in which said main rail comprises an I-beam having a central vertical web, and said carriage includes means spacing said saddles longitudinally and having first portions moving in the spaces between said main rail and said guide rails, and second portions jointly defining a space containing said web.

6. A splitter according to claim 1 in which said carriage includes first and second saddles and elongated means connected between said saddles for engaging said main rail and said guide rail.

7. A splitter according to claim 1 in which said carriage includes means positioned for reception in the space between said rails.

8. A wood splitter according to claim 1, including splitter elements mounted on said main rail near first and second ends, and the center, of said trackway, and spaced rams carried by said carriage for longitudinal movement between the center splitting element and the first and second end splitter elements respectively.

9. A wood splitter according to claim 1 in which said main rail and said guide rails comprise a frame for said splitter, and wheeled means for supporting said frame.

10. In a wood splitter, in combination:

an elongated main rail;

a pair of guide rails aligned with and spaced oppositely from said main rail, to form therewith a longitudinal trackway;

means securing said guide rails at their ends to said main rail to define the length of said trackway;

a carriage movable longitudinally along said trackway, including means engaging said guide rails, and having first and second saddles separated by a longitudinal distance less than said length of said trackway;

a pair of linear motors acting longitudinally on said carriage at sites outward of said main rail to cause reversible movement of said carriage along said trackway;

a pair of inwardly directed splitter elements mounted on said main rail near first and second ends thereof;

a double-faced splitting element mounted on said main rail near the center of the length of said trackway; and a pair of rams carried by said saddles for longitudinal movement between the center splitting element and the first and second end splitter elements respectively.

* * * * *